United States Patent [19]

Othmer

[11] 4,251,227

[45] Feb. 17, 1981

[54] METHOD FOR PRODUCING SNG OR SYNGAS FROM WET SOLID WASTES AND LOW GRADE FUELS

[76] Inventor: Donald F. Othmer, 333 Jay St., Brooklyn, N.Y. 11201

[21] Appl. No.: 930,327

[22] Filed: Aug. 2, 1978

[51] Int. Cl.[3] ..... C10J 3/00; C10K 3/00

[52] U.S. Cl. ..... 48/197 R; 48/197 A; 48/202; 48/209; 252/373; 260/449 M; 260/449.5; 423/359; 423/551; 423/554

[58] Field of Search ..... 48/197 R, 202, 206, 48/210, 209, DIG. 7; 44/1 R, 1 B, 1 D, 1 G, 10 R, 10 A, 10 B, 10 C, 10 D, 10 E, 10 G, 27, 32, 33; 423/359, 525, 526, 551, 554, 555; 260/449 M, 449.5; 252/373; 201/9, 17, 38; 203/11; 210/63 R; 162/31

[56] References Cited

U.S. PATENT DOCUMENTS

| | | | |
|---|---|---|---|
| 2,668,099 | 2/1954 | Cederquist | 44/33 |
| 2,773,026 | 12/1906 | Cederquist | 162/31 |
| 3,632,479 | 1/1972 | Lee et al. | 201/9 |
| 3,692,634 | 9/1972 | Othmer | 203/11 |
| 3,909,211 | 9/1975 | Diaz et al. | 201/17 |
| 3,909,212 | 9/1975 | Schroeder | 201/17 |
| 3,920,506 | 11/1975 | Morgan | 210/63 R |
| 4,017,421 | 4/1977 | Othmer | 203/11 |
| 4,054,420 | 10/1977 | Longbach | 201/17 |
| 4,055,400 | 10/1977 | Stambaugh et al. | 44/1 R |

FOREIGN PATENT DOCUMENTS 2521132 11/1976 Fed. Rep. of Germany ..... 44/10 E

OTHER PUBLICATIONS

Chemical Engineers Handbook, 4th Edition, Perry, pp. 19–40, 1963.

*Primary Examiner*—Peter F. Kratz

[57] ABSTRACT

Peat, lignite, coal, many forms of biomass (land or marine) and solid wastes may have from ½ to 30 times as much water associated with the dry solids. Some of this water may be chemically bound or otherwise may be practically inseparable by mechanical means. The solids may be partially oxidized by oxygen or air in the first chemical reactions of a Wet Air Oxidation (WAO) taking place in the presence of the large amount of water at temperatures of 175° C. to 325° C. and pressures of 10 to 100 atmospheres—preferably 240° to 300° C. and 70 to 100 atmospheres. All sulfur in high sulfur coal is oxidized selectively to the sulfate radical; and heat to bring the combustible up to the necessary temperature is supplied by burning part of the combustible itself. The sulfur free coal may be used as conventionally. Residual solids (now 70 to 95% of the original fuel) have a higher heating value on a dry basis, and are mechanically separated from all but ½ to 2 pounds of water. These solids come from the dewatering unit at a high pressure and may be passed, without loss of pressure or temperature, to be gasified in conventional processes and gasifiers, again by partial oxidation.

36 Claims, 1 Drawing Figure

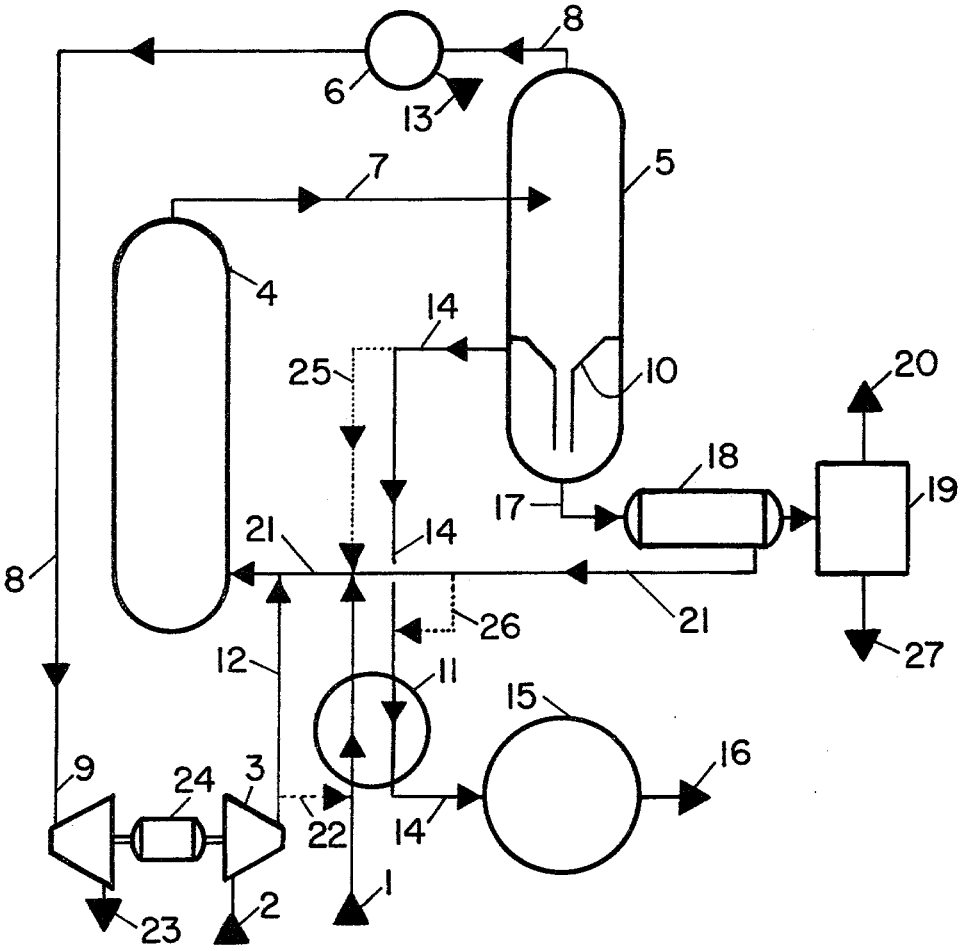
8
6
13
5
7
4
14
25
10
20
18
19
17
21
14
8
21
26
27
12
11
15
16
9
24
3
22
14
1
23
2

METHOD FOR PRODUCING SNG OR SYN-GAS FROM WET SOLID WASTES AND LOW GRADE FUELS

This invention describes the production of power and burnable gas mixtures from solid combustible organic materials associated with from ½ or 1 to 30 times as much water as dry solids by chemical reaction of the carbon of the combustible with some of the original water. The burnable gas contains among other gases, carbon monoxide and hydrogen. Further processing increases its heating value to make substitute natural gas (SNG). Alternatively the burnable gas mixture may be converted to a synthesis gas (syngas), possibly after admixture with other gases, to produce chemicals including, for example, methanol or ammonia.

The original solid materials—hereinafter called simply *combustibles*—may contain water in an amount from ½ or 1 to 30 times the dry weight of the solids. Some of this water may be in a colloidal form, chemically bound to the solids or otherwise associated so that it is impossible or extremely difficult to separate from the solids. The process requires from 1 to 2 pounds of water per pound of dry solids; and more water may be added if below this amount.

Combustibles which may be used in the new process to produce power and/or burnable gas mixtures include: (a) wastes or refuse of paper, wood, or related materials, (b) biomass as land or marine vegetation ot its wastes after other processing, (c) garbage, (d) sewage sludges, or (e) low grade solid fossil fuels in the coalification rank from peats of all ages and fiber contents, through lignites, and coals. These fossil fuels may contain, or be closely associated with, substantial amounts of water much of which may be in a more or less "bound" or chemically combined state; or coal fines may be so small in suspensions tht they sediment out extremely slowly.

Particularly the low grade fossil fuels may contain such large amounts of sulfur as to be unusable. The first reactions of this invention burn this to sulfuric acid—or a sulfate if alkali is present. To bring the combustible up to the reaction temperature heat is used which comes from the partial combustion of the fuel itself. The fuel then may be gasified to the burnable gas or burned conventionally.

In general, the available combustibles to be used are of low value, of no value, or actually a nuisance because: (a) they cannot be burned readily for their disposal, which may be necessary; or (b) they contain too much water and/or sulfur and/or ash for economic conventional burning, or for shipment to a point where the heat they could produce might be used advantageously. Some of water contained—often a very large percent—is chemically bound or loosely associated with some of the compounds in the combustibles and cannot be removed mechanically. If this bound water is dried off at a temperature above the boiling point of water, the combustible often may be so hydroscopic that it will reabsorb water from the air.

Basically the advantageous process which has been developed is a combination of several elements. Some of these are known and long used methods which are now integrated in such a way as to give new combinations of products and unexpected advantages. Several of these elemental methods or processes are:

(a) *Partial wet combustion,* is often called partial wet air oxidation (WAO), although pure or 90% oxygen from an air separation is often used to advantage. The combustible organic materials are thus partially burned in their large excess of water—at least one and up to thirty or more times the weight of the dry solids. If this ratio is too low, e.g. less than 1 to 6 for feeding and operating the WAO, water is added. The temperatures in the reactor may be above about 175° C. and up to 325° C.; and the pressures may be above about 10 atmospheres and up to 100 atmospheres. The preferred range of temperatures is 240° C. to 300° C. In the reactor the first chemical reactions are related to the WAO which gives a thermally conditioned residue, or substantially a more highly coalified fossil fuel than that charged. These first chemical reactions are in the liquid phase. While all of the organic material can be oxidized in a complete WAO, only a predetermined part may be burned if desired. This is by a controlled and partial WAO of less stable compounds, which hold or bind the water, through a limiting of the supply of oxygen. A solid, thermally conditioned residue results containing no bound water and capable of being dewatered mechanically. Most of the heating value is retained in the solids and is realized in the final, burnable gas which is made by the second reactions in the gasifier of the carbon and a part of the water of the original combustible.

All sulfur in the combustible is preferentially and practically quantitatively oxidized to give sulfuric acid or, in the presence of an alkali, the corresponding salt. The oxidation of sulfur is immediate and may be under much milder conditions than necessary for other constituents of the combustible. It may be the principal reason for the WAO, which brings the combustible up to temperature by a partial combustion of the other components of the combustible. Coal then may be used as conventionally since it is sulfur-free or go on to the gasification.

Some part of the solids being subjected to the pressures and temperatures of the partial WAO will be hydrolyzed, simultaneously with the partial combustion of others, to give sugar like constituents, soluble in the large excess of water. If sufficient oxygen as such or in air is supplied, the original combustible is oxidized completely to $CO_2$ and water.

(b) Vapor Reheat interchanging of heat as a means of cooling some or all of the residue of the partial WAO or of the water therefrom while heating the aqueous medium carrying the original combustible, usually in slurry form.

(c) Fermentation of the water soluble materials, formed by the WAO, also by hydrolysis. These are mainly dissolved solids in the water separated from the thermally conditioned solid residue of the WAO. Fermentation of these by known means gives alcohols, acids, yeasts, and other usual products of fermentation.

(d) Separation of the solids by settling or other clarification and thickening process so as to be able to decant off as much as possible of the water.

(e) Mechanical dewatering of the solids remaining after the partial WAO and thickening processes by any one of the presses or other systems used for such purposes. A suitable one is the standard screw press expeller used particularly in the vegetable oil and cane sugar industries and fitted, as is sometimes the case in other industries, for a pressure discharge of liquid and solids when desired.

(f) Gasification of the thermally conditioned residue of solids as discharged from the mechanical dewatering means. This residue may be at a pressure at least as high as that of the gasifier. Modern gasification processes begin with a partial oxidation, often with pure oxygen, of the carbon of the fuel, then a shift conversion whereby part of the carbon monoxide formed and more carbon combine with water to give hydrogen. These second chemical reactions are accomplished in the gasifier. Here the gasification is accomplished in any one of the well understood processes by the chemical reaction of the carbon of the solid residue with oxygen, then with the water which has not been separated away from, but is still contained therein.

The particular object in this invention is first, the production of a burnable gas containing CO and $H_2$, then the subsequent conversion of this gas to one of the high quality necessary for pipeline distribution e.g. as a substitute natural gas (SNG) giving at least 900 and preferably 950 to 1000 BUT/cu.ft. Alternatively it may be converted to a synthesis gas, syngas, for the synthetic production of chemicals.

The practice of this invention uses many items of equipment, more or less standard in chemical engineering practice. These include reactors, heat interchangers, expansion turbines or related steam or gas engines for producing power, air compressors, gasifiers, electric generators or alternators, etc. as well as interconnecting piping, valves, controls, with necessary instrumentation etc. All such items of equipment are conventional in the art. However in this use, as in any other, they must always be designed or specified individually for the particular conditions and services involved.

The screw press dewaterer is the only unit wherein there is any variation in use from the most customary service conditions of a standard unit. Conventionally, the liquid discharged from the press is at about atmospheric pressure, the same as is its feed; and the deliquified residue containing from ½ to 2 pounds per pound of dry solid is expelled from a pressure of some thousands of pounds per square inch down to atmospheric pressure. In some industries discharges up to 10 or more atmospheres pressure are used. Generally this is sufficiently high for the present liquid discharge; but a somewhat higher pressure may be desirable; and no substantial changes in design are involved. For usage under pressure the inlet passage and the casing around the cylinder supporting the screen through which the liquid is pressed is constructed of heavier material as has been done in other cases, so as to enable it to withstand an internal pressure equal to that of the reactor, or slightly more. Thus the water pressed out of the solids may be at a pressure high enough to allow it to flow back to the reactor.

Similarly the solids being expelled by the screw, instead of dropping out at atmospheric pressure, are discharged to a pipe leading directly to the gasifier at whatever its pressure may be—sometimes as much as 1000 psi or more. The action of the screw press is not changed, nor is the power required for its operation increased significantly by having the two phases discharged at different pressures—both high—compared to their most common discharges, both at about atmospheric pressure. However, there is a notable heat economy obtained by expelling from the press the solids, containing from about ½ to 2 pounds of water per pound of dry solids directly to the high pressure of the gasifier without having the drop in pressure and the cooling by flash evaporation of the water—hence drying. This saving of heat by not reducing the temperature and pressure is an important advantage of this process.

Combustible Solids and Their Desulfuring and Partial Dewatering

The invention converts to a burnable gas many otherwise useless materials: solid fossil fuels of low rank as peat, lignite, and coals, also sewage sludges, also biomass—both land grown and marine grown, including kelp and so-called sea weeds. Any of these may contain large amounts of water intimately bound in the combustible mass, often as a gel due to a colloidal bonding probably by very large but relatively unstable molecules. This amount of water, which cannot be separated mechanically, may be a substantial part of the 70 to 90 or even 95% for peat as it is harvested, and up to 40% or more for lignites. Such a large amount of water precludes the direct burning or other utilization of the low rank fuel at the mine, and even more its shipment to distant points of possible utilization.

A large part of this water may be removed, usually by air drying in the open, down to one or two pounds of water per pound of dry solids; but there is still an amount of water retained or chemically bound which is in equilibrium with the ambient. Its amount depends on the particular combustible, and it reduces greatly the value of the combustible. Also the air drying may add an unacceptable charge to the fuel. At least 1 or 2 pounds water per pound dry solids is usually necessary for feeding and operating the WAO, and water may be added to the feed.

In many cases, the cheapest way to transport coal of whatever rank is in a water-slurry of ground particles in pipelines from the mines to the point of its use. Thus the coal is necessarily present as finely divided particles in water, ready for partial WAO for its thermal conditioning and desulfurization either at the mines or at the destination where it is to be burned at the other end of the pipeline.

Water separated from pulverized coal after long distance piping and before burning contains typically 20% coal fines below 40 microns diameter—too fine to settle out in a reasonable time. These fines are formed by attrition of the much larger particles in the water slurry, which are then separated for burning. Any fines below the 100 micron range are difficult to settle out or to handle otherwise. This "ink", as it is called, has been a major nuisance in the pipe line transport of coal. It may, however, be used as a combustible in the process of the present invention.

With some high sulfur coals, particularly when they have been ground, and transported by pipe line in a water slurry, the desulfurization of the partial WAO may be the important effect in conditioning the coal prior to its gasification or other use. With the addition to the WAO reactor, or after it, of an alkali which gives a water soluble sulfate in neutralizing the sulfuric acid formed, most of the sulfur is eliminated with the water discharged in the dewatering step. Sulfates, which are dissolved in the small amount of water remaining with the solids, go out in the ash from the gasifier. If water insoluble sulfates as $CaSO_4$ and $BaSO_4$ are formed, these are found to go out in the ash from the gasifier almost quantitatively.

Prior art processes for oxidizing the sulfur in coal or other combustible by an oxygen containing gas, have supplied external heat to bring up the temperature in the autoclave by steam coils or other heat transfer surfaces. Always care has been taken not to oxidize or burn with the oxygen the combustible itself. It has been found that these heat transfer surfaces must be large and expensive. Also much less energy is required by a partial WAO which is used to supply directly the necessary heat to bring the combustible up to the desulfurizing temperature than is used by an external boiler to supply the steam. By operating the WAO at temperatures above about 240° C., and gage pressures above about 70 atmospheres, practically all sulfur is completely oxidized within 10 to 60 minutes. Heat is supplied by the WAO of part of the combustible, in many cases while it, itself, is being conditioned.

If coal or lignite is to be so treated it may be crushed or ground to any convenient size, from 10 to 200 mesh, which is desirable for its ultimate use. It is to be intimately mixed or associated with from 1 to 30 times its dry weight of water. Peat is already in an intimate mix or association with water. Sulfur whether elemental, pyritic, or in organic compounds may be practically completely eliminated from the fuel by a WAO to give sulfuric acid which may be neutralized in the WAO or after, by addition of an alkali. The sulfate formed may be soluble, as $Na_2SO_4$, or insoluble as $CaSO_4$.

Operation of the partial WAO is most desirable at a temperature between 240° C. and 300° C. and a gage pressure of from 70 to 100 atmospheres. Heat for bringing up to temperature the fuel and water is secured by partial oxidation of the fuel. The desulfurization well prepares the fuel for use subsequently either in a gasification or in other uses as a primary fuel.

Methods of the prior art utilizing air or oxygen have succeeded in converting the sulfur to: (a) its elemental form whereby it could be extracted from the fuel by one solvent, such as kerosene or other naphtha fraction, or melted out, away from the fuel; (b) an organic form whereby it could be extracted by another solvent, e.g. aqueous ammonia, and (c) a soluble sulfate form which would be washed out by water. The present process has the obvious advantage of simplicity and economy, as compared to the large number of steps of the prior art for handling several ultimate forms of the original sulfur.

The solid residue after the WAO and the sedimentation, or after the dewatering may be withdrawn without going to the gasification step. The neutralization—either in the reaction zone or afterward—may be accomplished, if desired with an alkaline material giving a soluble sulfate, e.g. $Na_2SO_4$. This will go off with the water to a large extent after the filtration or pressing of the residual solids, which may then be washed by known washing systems if desired so as to reduce the sulfuric acid or the soluble sulfate in the residual solid fuel down to any desired value. The soluble sulfate may be recovered for reuse if desired by known methods; i.e. by precipitating with lime and washing by counter-current decantation. Alternatively the alkaline material may be one which gives an insoluble sulfate, and most of this will stay with the residual solid fuel after the dewatering step, if this should happen to be preferred as the simpler method.

The combustible will be subjected to the first chemical reactions of the process in what is only a partial WAO. These reactions accomplish its thermal conditioning to allow ready removal thereafter of most of the water through drainage, centrifuging, filtering, or pressing using a press of the screw or other type. The filterability of the solids may be increased by the WAO by some 50 to 100 times. If the hot, thermally conditioned combustible is discharged to the open, as in the prior art pressing of oil seeds, it will lose much of the sensible heat at its heat temperature and pressure, largely due to the flash evaporation of some amount of its retained water.

Instead, the conditioned combustible is partially drained and then pressed for dewatering at the high temperature and pressure of the reactor, or that of the discharge of a heat exchanger, which may use either conventional surfaces or Vapor Reheat. In some cases pressing at the temperature of the reactor may be more economical of heat, in others the preliminary heat exchanging may be preferred before the pressing. In either case the pressure of the separator which is about the same as that of the reactor, may be maintained on the liquid discharge from the press. However, a much higher pressure may be maintained on the solids discharge to the gasifier, more nearly that reached in the press itself.

Thus one of the several ways of substantially dewatering the hot combustible after its thermal conditioning, without losing its own pressure—and temperature—is by means of a screw press expeller as is standard in the vegetable oil and cane sugar industries. The solids are highly compressed by a screw in a tube with water discharged through holes in the tube. The casing around the tube for this service is made tight and sufficiently heavy to withstand considerable internal pressure, i.e. somewhat greater than that of the reactor. The discharge of the water pressed out would be at the same pressure as that of the reactor, or higher, while in practice the solids may be discharged at a considerably higher pressure if necessary to discharge into a high pressure gasifier. This is possible because of the very high pressure on the solids which is reached in the expeller.

The hot solids discharge of the screw press expeller, or other means for dewatering, may still contain from 0.5 to 2 pounds of water per pound of dry combustible solid. These residual solids will have been thermally conditioned, with substantially all of the sulfur burned to the $SO_4$ radical by the WAO in the presence of water. Their unit heating value on the dry basis has been increased by from 5 to 25% above that of the original combustibles charged.

Some highly oxygenated organic compounds of large molecular weights in the original combustibles are relatively "soft" or easily oxidized or broken down otherwise during the partial WAO. These, because of their high oxygen content have the least heating values per pound; and their weight loss will show less effect than the average heat of combustion per pound in the residue. The remaining solids therefore will have a higher unit heating value. Now thermally conditioned, they also have a higher amount of fixed carbon as well as a higher unit heating value per pound of dry material than the combustible material fed to the process. Also other constituents of the combustibles charged, e.g. cellulose, if present, have been found to be hydrolyzed; and the sugars resulting from the hydrolysis are dissolved in the water.

Thermal conditioning of peat or lignite by such partial WAO is a phenomenum well recognized to be analogous in effect, if indeed not in chemistry, to the continued coalification which takes place in nature of the original vegetation over millennia of geologic time to increase the rank of the fossil combustible. Similar thermal conditioning by the action of heat, water, oxygen and pressure gives similar results with wood wastes, other biomass, and sewage sludge, among other low valued combustibles. Such thermal conditioning has been found essential to upgrade the peat or lignite so that it may be burned efficiently, converted to a synthesis or burning gas, or so increased in value through the loss of water and/or sulfur as to warrant transportation of the solids themselves for use at some distant point.

The treatments of the prior art for thermal conditioning have cost many dollars per ton to improve correspondingly peat or lignite before gasification; and some have required the autoclaving, with input of considerable heat through heat transfer surfaces to evaporate all water present and to heat the solids to as high as 675° C. under pressures up to 3,000 psi. Since the heat required comes from that available in the fuel itself, it is obvious why these prior art processes are relatively inefficient in overall recovery of available heat in the final burnable gas. Usually these processes have removed none or only a part of the sulfur, making necessary the desulfurization of the burnable gas after it is produced. In the aqueous partial oxidation of the WAO, sulfur is removed almost quantitatively. Thus the fuel may be burned under boilers without scrubbers to remove sulfurous gases, or it may be converted immediately to a sulfur free gas.

Gasification of the Prepared Combustible

The thermal conditioning, desulfuring, and mechanical dewatering has prepared the original combustible for gasification. It now contains from ½ to 2 pounds of water per pound of dry solid, and no sulfur. It has a higher heating value on a dry basis, is more chemically reactive and has much better physical properties, for use either in a subsequent gasification or as a solid fuel.

Gasification by modern processing starts with a partial oxidation of the carbon in the solid by oxygen—usually, rather than by air, so as to eliminate the large volume of nitrogen present as a diluent. There is the accompanying interaction with the water still remaining after the pressing to give a burnable gas containing CO and $H_2$, also usually a much lower percentage of $CH_4$.

Some of the important of the second chemical reactions—for gasification—are:

$$C+O_2 \rightarrow CO_2 \text{ (Supplies heat to raise reactants to optimum temperature)} \quad (1)$$

$$C+H_2O \rightarrow CO+H_2 \text{ (at the high temperature, about 1000° C., residual water, now vapor, reacts)} \quad (2)$$

Equation 2 (endothermic) absorbs heat given off in Equation 1 (exothermic) as the carbon of the solid reacts with water from the original combustible, which is still present, now as a gas. If air supplies the oxygen, the large amount of nitrogen gives a final gas with much $N_2$ and a heating value of only about 150 BTU/cu.ft. Usually nitrogen is not desired in the product gases. Instead oxygen which has been separated from the air is used to oxidize the carbon, and the burnable gas resulting has a heating value of about 300 BTU/cu.ft.

$$CO+H_2O \rightarrow CO_2+H_2 \text{ (Shift conversion of CO and more water present to } H_2\text{)} \quad (3)$$

By addition of the Shift Conversion, Equation 3, to 3 times Equation 2, there results:

$$3C+4H_2O \rightarrow CO_2+2CO+4H_2 \quad (4)$$

Equation 4 is thus the ultimate theoretical equation to give a burnable gas utilizing the solid and the water of the original combustible. The $CO_2$ present in this burnable gas is readily removed by scrubbing with a liquid which absorbs it—by chemical reaction. In usual processing, sulfurous gases are also removed at this point. Here however, all sulfur has been quantitatively removed by the WAO by oxidizing to the $SO_4$ radical which is combined with lime or other alkali.

After other purification and balancing requirements, this syngas may be reacted over catalysts to produce, for example, methanol.

$$2CO+4H_2 \rightarrow 2CH_3OH \quad (5)$$

By suitable separation steps or controlled operation of the gasification, the hydrogen may be separated for use in producing ammonia, in which case air is used in the previous reactions so as to leave its residual nitrogen. There is possible the hydro-gasification or methanation reaction using $H_2$ from Equations 2 and 3:

$$C+2H_2 \rightarrow CH_4 \quad (6)$$

Also there is the catalytic methanation using CO from Equation 2:

$$3H_2+CO \rightarrow CH_4+H_2O \quad (7)$$

Equations 6 and 7, depend on Equation 1 to maintain the temperature and to supply the heat necessary for the other reactions of Equations 2, 3, and 4, all of which are endothermic. They supply CO and $H_2$. Equations 6 and 7 then produce, after separation steps, substitute natural gas, SNG, principally methane. The heating value of this pipeline quality gas is above 900 and usually between 950 and 1000 BTU/cu.ft.

Thus the Equations 2 and 3, make a burnable gas—containing CO and $H_2$—from the carbon and retained water of the combustible, now thermally conditioned and completely desulfured, at the pressure at which it is discharged from the dewatering unit. This burnable gas may be burned as such; but because of its low heating value it does not warrant piping for any substantial distance. Alternatively, it may be further processed in known means by known methods to give a substitute natural gas or a syngas. Since all sulfur in the combustible has been quantitatively removed by the WAO, it will not disturb catalysts used in the shift conversion of Equation 3, or in reactions such as that of Equation 5 for producing methanol.

In either case, the water remaining with the original combustible, after the partial WAO and the partial mechanical dewatering is used with the carbon of the original combustible to make the product, burnable gas. By contrast, conventionally steam is added to supply this water in the usual gasification processes. Equation 4 shows a weight ratio of water required to that of carbon of 72 to 36 or twice as much water is required as the amount of carbon with which it reacts. This much of the water present in the original combustible may thus remain to be present in the solid residue after the partial WAO and the mechanical dewatering. It is used in the production of the burnable gas by its chemical action with the carbon of the combustible. If there is less water remaining after dewatering the solids, some steam or superheated steam may be used as in the prior art. Under normal operation, this is not necessary.

There are numerous variations of the equipment for accomplishing these and the numerous corollary reactions in many different arrangements and under quite different conditions. These, per se, are not the province of this invention.

Accomplishment of Present Invention

The object of the invention which is indeed accomplished is:

The economical thermal conditioning, desulfuring and coalification through first chemical reactions of solid combustibles associated with water, such as: peat, lignites, coal or coal wastes, various wet solid wastes and biomass from many sources, including both land and marine vegetation, and using directly only a small amount of heat obtained from the combustible itself; then the conversion by second chemical reactions in a gasifier of the resulting solids and a part of the water originally present and still retained in the solids to a sulfur free burnable gas. This may be processed further to give a SNG or a synthesis gas. The entire process may operate without cooling or reducing the pressure of the solid combustible and the water it contains during their conversion to a highly useful gas.

OPERATION OF THE PROCESS

The FIGURE is a block diagram showing one of the interrelations of the several steps of the process. All of the steps may not be used in any particular embodiment of the invention; and there may be other conventional steps added which are commonly used in chemical processing e.g. phase separations, purifications, additions of acids, or alkalis, etc.

Flows of materials to and from the several steps are indicated in the figure, but necessary pumps, valves, measuring and controlling instruments are not; and the flow sheet has no scale. If used in some of the equipment, normal materials of construction will experience considerable corrosion: as examples the reactor, separator, screw press, and heat exchanger. These and other items, also the connecting piping, valves, pumps, etc. will be constructed of suitable corrosion resistant materials for their particular function, using correct fabrication methods well known in the art. Some parts will be made or lined with stainless steel, titanium, or tantalum, or will have acid proof brick linings.

Screw presses are standard equipment in expelling oil from oil seeds, also dilute aqueous sugar solutions from sugar cane solids. Such presses may be used for dewatering the conditioned combustible, since the association of the bound water has been destroyed. When operated with a discharge under pressure as here, the casing of the press, which surrounds the perforated sleeve in which the screw fits, is made heavy enough to withstand whatever pressure is desired. Here, that pressure is equal to that of the reactor—so that the water pressed out may flow back to the reactor. Also the solids are expelled under pressure into a tube taking them directly into the gasifier and under its pressure.

None of these more or less standard process steps or items of equipment constitute, by themselves, this invention, which resides in the novel combination of parts and the methods of their use to secure, in aggregate, the new process with unexpected and useful results.

In the figure, the raw combustible is fed in at 1 admixed with considerable water, usually as a slurry with from 1 to 30 pounds water per pound of dry solid. Additional water may be added if necessary, e.g. below 1 to 1, to facilitate the operation. A suitable pump for the feed, such as those long used for similar purposes, gives a pressure equal to that in the reactor—plus that required to overcome the pipe friction. Usually, but not always, a heat exchanger is used at 11, either a standard shell and tube unit, or a Vapor Reheat unit using a multi-flash of hot liquor being discharged and multi-condensing of vapors so formed to heat the incoming feed as described in U.S. Pat. No. 3,692,634 and below.

Oxygen and air in any ratio, or usually either air alone or commercial oxygen (90±% $O_2$) alone enters at 2. While the term Wet Air Oxidation or WAO is used, this includes the use of oxygen instead of air or of any mixture therewith. The compressor, 3, may pass the oxygen containing gas directly through line 12 to join the preheated feed in line 21 or it may first be passed through line, 22, to join the cold feed in passing through 11. The preheated feed and the air passes through line, 21, to enter the reactor, 4, desirably at a temperature of 175° C. or more, and at a pressure of 10 atmospheres or higher.

If a lower temperature is experienced due to insufficient, or no, heat interchanging, the initial feed and the reactor, 4, is preheated to a temperature above about 175° C. to start the first chemical reactions which take place in the reactor. These then continue autogenously, because they are exothermic, and, of course, involve the burning of part of the combustible itself. They are controlled by limiting the supply of the oxygen containing gas supplied at 1. The large amount of heat given off in the partial WAO of the first chemical reactions immediately heats newly fed combustible material and its accompanying water up to the desired reaction temperature. The heat developed can cause the temperature to rise to as high as 325° C., and the pressure to 15 to 100 atmospheres if desired to secure the desired coalification or thermal conditioning of the combustible. Both temperature and pressure can be raised to even higher levels if necessary with some particular combustibles. However, the maximum for the desired coalification is about 325° C. and 100 atmospheres, usually both will be considerably lower, and the best range is from about 240° to 300° C. Control of the reaction is secured by the amount of air supplied in reference to the amount of feed, and to the throttling of the valve on the discharge line, 7, of the reactor, 4.

Residence time in the reactor is from 2 to about 200 minutes depending on the type of combustible supplied, the actual temperature in the reactor, and the degree of coalification desired. The degree of coalification or rank secured is usually higher with higher temperatures and pressures, but control becomes somewhat more difficult. One important criterion of the optimum extent of the reaction is the consistency or plasticity of the particles of solids leaving in the discharge line, 7. Firm, readily filterable particles are desired; and these may usually result from a higher temperature and a longer time in the reactor. Both control therefore the extent of the partial combustion or other destruction of the relatively "softer" solid compounds in the combustible, those which are more highly oxygenated. Sulfur, either elemental, as inorganic sulfides, or in organic form is preferentially burned to the sulfate, $SO_4$, radical in even a very mild WAO; and this may be neutralized by adding an alkali to the combustible being fed or to line 7, or to the discharged water. This gives the corresponding sulfate.

In general only a small amount of the combustible is burned in the first chemical reactions involved in the reactor of the partial WAO to secure its thermal conditioning, coalification, or desulfuring. This may be indicated by a lessening by from 10% to 35% of the total heating value of the residual solids as compared to that of the original combustible. However, the unit heating value (dry basis) of the lesser amount of solids obtained has been found to be increased by from 10 to 25%.

The first chemical reactions form an amount of water soluble organics which, since they are in the aqueous layer, are not available in the heat in the solids separated for later gasification. These water solubles may come, as does acetic acid (which has the same number of carbon atoms as oxygen atoms in the molecule, as does CO also) in an intermediary step in the total oxidation of organic molecules to $CO_2$. Hydrolysis has also been found to take place under the temperature and pressure conditions of the reactor to give sugars and other highly oxygenated molecules; e.g. from cellulose. Such hydrolysis is catalyzed by the acid condition which follows from the formation of acetic acid, and particularly sulfuric acid by the preferential and quantitative oxidation of all forms of sulfur present.

Sulfuric acid comes from the highly preferential and complete oxidation in the presence of water of any sulfur, of either an elemental, pyritic, or organic nature which is present in the combustible. An operating temperature above 240° C. with pressure above 35 atmospheres has been found to give complete conversion to $SO_4$ in not more than 120 minutes for combustibles, including coal when pulverized. The heat necessary to bring the combustible to this temperature necessary for the rapid desulfuring reaction is supplied by the partial combustion of some of the combustible. Addition of lime, caustic soda or other alkali to the feed will neutralize the several organic acids formed to give the respective salts, also the sulfates. It may be desirable to recycle a part of the separated water to the reactor through line, 21, without neutralization. This will allow sulfuric and/or organic acid concentrations to build up in concentration to make their recovery simpler. Also this higher concentration increases their activity as a catalyst for hydrolysis. If on the other hand an alkali such as lime, caustic soda, soda ash etc. is added, these acids form salts which up to their solubility limits are contained in the water phase. Insoluble amounts are in the residue.

The entire reaction mass and its products—solid, liquid, and gaseous—pass through 4 continuously and out the discharge line, 7, which has a control valve activated by changes in temperature (usually) or pressure. This regulates, with the control of the supply of the oxygen containing gas, the desired extent of the reaction of a given amount of feed. The pipe, 7, discharges inside the separator, 5, preferably tangentionally to its wall so as to give the swirling action of a cyclone, and thus to assist the separation of the gas phase which rises and discharges from the top by line, 8.

Some small amount of volatile organics or CO may be in this gas-vapor stream and these may be oxidized directly by the addition of oxygen or air through line, 13, to an after-burner, 6 in the line 8. A catalyst of conventional type and a means of supplying a small external source of heat, not shown, may be used to insure the complete oxidation in 6 of any flammable materials.

Line, 8, discharges the steam, nitrogen, and $CO_2$ mixed with any other gaseous products of the WAO—but no sulfur compounds—to a turbine, 9, or other expansion engine having an ultimate discharge or exhaust, 23. This may be on the same shaft as a combination motor-generator, 24, and the air compressor, 3. If 9 develops more power than 3 requires, then 24 converts it to electricity. If the air compressor, 3, requires more power than that developed by the turbine, 9, then 24 acts as a motor to supply the difference. When the extent of the optimum partial WAO for the thermal conditioning requires considerable combustion, the heat in this steam-gas discharge will be greater; and more power will be produced in 9, hence in 24.

The lower part of the separator, 5, may be of any conventional design and with any conventional internals for sedimentation and thickening of the solids-water mixture. One standard type is the usual slow moving rakes beating down the solids from the mixture, with the water rising therefrom, and the solids discharging at the bottom. Another is the plate type separator, one example of which is that described in applicant's copending application Ser. No. 694,954, now U.S. Pat. No. 4,151,075. Other types also will concentrate or thicken the mixture. As shown, however, 5 has a simple internal funnel arrangement 10, to direct the mixture to the bottom. Water which separates rises in the annular space and is decanted off by line, 14, just below 10.

The somewhat thickened water-solids mixture is withdrawn through line, 17, and dewatered by any one of several standard devices, an exemplary one being a screw-press, 18. This is a conventional design used in the oil seed and sugar cane industries, with a heavier casing specified on the standard machine so that it can operate under the full reactor pressure on the liquid side. The discharge connection also is strengthened so that it can operate at the possibly higher pressure of a gasifier, 19, for the delivery of the solids thereto. Thus the water pressed out of the solids may be returned to 4 by pipeline, 21. A small transfer pump (not shown) suffices since it operates against no substantial pressure. The dotted line, 26, allows all or part of this separated water to join that leaving the separator in 14, so that it also may give up much of its heat in heat exchanger, 11, to preheat the feed.

The soluble organics in the water leaving in 14 are the result of hydrolysis and partial WAO of the softer constituents of the combustible charged. These may have value as they are, or after further conventional processing. Thus, as an example, acetic acid, formic acid, and some of the higher homologous acids may be present. They may be separated out and purified by known methods in equipment represented merely at 15 as including that which is necessary for chemical processing of soluble values in the spent liquid after the partial WAO. Also there may be in addition to or instead of these acids, sugars or other oxygenated compounds formed by hydrolysis and/or the partial WAO. If an alkali has been added to the feed at 1 or otherwise to 4 the corresponding salts—also some sulfates will be present.

Any usual chemical processing or separating steps to obtain these values may be used. One example, useful in most cases, is fermentation. proper selection of microorganisms for fermenting the solubles in these liquors in 15, which now represents a fermentation plant, will give alcohols, acetone, yeast, single cell protein, or other conventional products of fermentation technology. The ultimate aqueous waste discharges at 16.

The solids discharged from the dewaterer, 18, here a screw press, although other conventional devices may be used alternatively, will leave from about one half to two pounds of water per pound of dry solids. Their temperature may approximate that of the high temperature of the reactor. They may be compressed, then discharged by a screw expeller or press at a considerable higher pressure than that of the reactor, 4, or separator, 5. The dewatered solids from 18 have heating values on a dry basis significantly higher than those of the low grade combustibles charged into the system. These have been found to be between 9,500 and 12,000 BTU per pound. Residual water is no longer chemically bound; and, if desired, the solids may be dried completely by usual systems. They do not adsorb water hydroscopically thereafter, as would the original unconditioned combustible. If an alkali has been added to the feed of combustible at 1 or otherwise to 4 to neutralize the sulfuric acid formed from the sulfur of the combustible; and if this alkali gives an insoluble sulfate, e.g. $CaSO_4$, $BaSO_4$, etc., this salt stays with the pressed solids in the solid phase and goes through the gasification, to be discharged with its final ash.

The gasification in 19 is a partial oxidation, usually with oxygen instead of air to prevent dilution with nitrogen, then a reaction of the carbon of the solids with the water which has been with them throughout the processing. This is the second series of chemical reactions; i.e. those in the gasifier, 19—the first chemical reactions being those in the WAO reactor. The residual solids have been "activated" by the WAO and are considerably more reactive to the chemical reactions of gasification by whatever process used than is, for example, a bituminous coal of comparable heating value.

Most modern gasifiers operate under considerable pressure so as to discharge product gas at a high pressure. After other processing, including methanation, the burnable gas may go to: (a) a pipeline if converted to SNG, or (b) a pressure reactor for chemical production if made into a syngas. In either case, operating the gasifier under pressure minimizes the compression costs of the product gas, which are considerable. If the burnable gas is to be used as such, pressure may not be advantageous.

The dewatered solids discharged from 18 may be passed immediately to the gasifier 19 under a pressure up to the maximum generated by the screw press, or through an intermediate pressure storage tank (not shown) insulated to prevent heat losses. The residual water in the solids discharged from 18 is used in the production of the burnable gas in 19 by its reaction with the carbon of the solids and then in the shift conversion of the CO formed as a first step. The block 19 represents the entire plant or gasifier, well known in the art for any of the conventional processes for production of gas from solids such as coal and steam. First, the coal is partially oxidized in the presence of water to give a burnable gas of about 150 BTU/cu.ft., if air is used; or 300 BTU/cu.ft. if oxygen is used. This then may be converted to a gas of pipeline quality, above 900 BTU/cu.ft., e.g. a substitute natural gas (SNG) which consists principally of methane. Alternatively, 19, may include a plant which starts with a gasifier of the conventional type for the partial oxidation of the residual solids with some of their original water still present. Then with the necessary accessories for processing, a a syngas is made from the previously thermally conditioned or coalified combustible and some of the water which it contained originally. Other gases as $CO_2$, $O_2$, $N_2$ etc. would be supplied as required for making the particular product desired.

Examples of such gasifying processes to be used in 19 with the solids discharged from 18 are the well known systems and methods exemplified by Lurgi, Cogas, Synthane, U-Gas, Texaco, Koppers-Totzek, and others. The gas so produced is discharged at 20 and the residual ash at 27.

However, all of these gasification processes are well known and do not per se, constitute the scope of this invention. Nevertheless; (a) the preparation and the direct coalification of the original combustible by the first chemical reactions in the WAO in combination with (b) the dewatering, and then (c) the second chemical reactions of gasification by partial oxidation of the carbon of the conditioned solids, while (d) reacting with part of the original water retained during these steps, have been found to give the substantial and unexpected advantages which constitute this invention.

Variations of Processing

The WAO process, one essential element of the series of steps which comprise the process of the present invention, may have various modifications. Each of these may have advantages under different conditions or with different combustibles. Thus the continuous Vapor-Reheat process of U.S. Pat. No. 3,692,634 may eliminate the heat transfer surfaces of the heat exchanger, 11, which heats the mixture of the combustible and water which is going to the reactor, while cooling the hot liquid separated from the thermally conditioned combustible. These heat transfer surfaces are expensive because they must be made of special metals to withstand the very corrosive conditions under which they must operate.

In using the Vapor Reheat process, the hot liquid is partially flash evaporated several or many times by being passed to each of a series of flash chambers, each at a successively lower pressure. At least two stages—usually three or more—are used in the series. The vapors from each of these flash evaporations are passed separately to heat the feed of the water-combustible mixture passing—in counter current to the hot liquid—as a stream of cooling and condensing liquid through a series of condensing zones of the same number as the flash chambers. The feed stream of cooling-condensing liquid being heated may be in open, dispersed flow (as a spray of droplets) in each condensing zone, which is at a successively higher pressure than the previous one. In this case steam, from the respective flash evaporation, contacts directly the extensive water surfaces of the feed stream on the condensing zone and condenses thereon. Alternatively the steam from each respective flash evaporation may condense on the wall of a metal tube or plate, on the other side of which is flowing in counter current the water-combustible mixture being heated.

Another variation of WAO which may be used in the present invention is that of the batch Wet Combustion Process of U.S. Pat. No. 4,017,421. This has some advantages, one being that the feeding of the water-combustible mixture is readily done by charging an open vessel, which is not under pressure at the time of charging. This eliminates the need for the special feed pump otherwise required. Also and again, there is no need for heat transfer surfaces in a heat exchanger since the steam flashed off in each successive batch flash evaporation passes to contact directly and condense countercurrently in the water-combustible mixture being heated in several other vessels.

The thermally conditioned and dewatered combustible discharged from any WAO system as feed stock for gasification is also free of sulfur in any form which will go into the product gas. The WAO preferentially, and practically quantitatively, has burned all elemental, inorganic and organic sulfur to $SO_3$. In water this gives the $SO_4$ radical in the form of sulfuric acid or as a sulfate. If an alkali as lime or caustic soda is added to the feed or the water ultimately discharged the corresponding sulfate is formed. When sulfuric acid is formed in 4, if the water in 14 or 21 is partially recirculated back to the reactor, the concentration will build up to a possibly desired strength of 5 or 6% sulfuric acid. When the relative flows through line 14 as draw off, and that through 21 back to the reactor 4, are controlled, the build up of acid can be regulated at any desired value.

On the other hand, if an added alkali gives soluble sulfates, e.g. $Na_2SO_4$ they are removed principally in aqueous solution through 14, also 11 and 14. The partial WAO may be used to desulfurize coal, for example, for gasification; and sulfur is thus eliminated at 14 and 16. If an alkali is used which gives insoluble sulfates, e.g. $CaSO_4$ and $BaSO_4$, these go through the gasifier unchanged as solids and are discharged in its ash at 27.

Gasifiers

The important step is the production of a burnable gas by partial oxidation of the conditioned combustible and the reduction to give $H_2$ of part of the water it contains originally. If air is used in the gasifier for the partial oxidation, its large amount of nitrogen dilutes the burnable gas, as produced, so it has a heating value of only about 150 BTU/cu.ft. If oxygen is used, this will be in the range of 300 BTU/cu.ft. Either gas may be used immediately as a local fuel, but has too low a heating value for distribution by pipeline. This low BTU gas may be used, however, in the preparation of a syngas or of pipeline quality SNG by separation processes and methanation to bring up its heating value to from 900 to 1000 BTU/cu.ft. These further processes always include well known and understood operations, always at very high temperatures in comparison with those in the WAO reactor.

The earlier steps of the first chemical reactions of the WAO and of the mechanical water removal have well prepared the combustible for gasification. Among the advantages of the solid feed to the gasifier are these: (a) It is completely free of elemental and organic sulfur, which has been preferentially burned out in the WAO. Thus there is no sulfur poisoning of catalysts in the shift conversion, so the most effective catalysts may be used even though they may be very susceptible to sulfur poisoning. If an alkali has neutralized the sulfuric acid to given in the WAO a soluble salt, most of the salt will have gone out with the water by subsequent washing if desired. Remaining salts and any insoluble sulfate will pass through the gasifier to go out with the ash.

(b) It is available at a higher pressure than the high pressure used in most modern processes for conventional gasification. Most of these operate at pressures of many atmospheres; they are usually still at some value well below the very high takeoff pressure from the conventional screw expeller, i.e. 2000 or more pounds per square inch. The operating pressures of the several available gasifiers are considerably below this; i.e. the Lurgi at about 500 psig, COGAS at 50 psig, Synthane at 1000–1500 psig, $CO_2$ Acceptor at 150 psig, U-Gas (Institute of Gas Technology) at 50–350 psig, Texaco at 250 to 1500 psig, Bi-Gas, Shell-Koppers, Koppers-Totzek nearer to atmospheric pressure.

As an example of a preferred gasifier, the Texaco system operating at 250 psig, or even much higher, will receive directly from the press the solid feed stock with the associated water, part of that originally present. Thus the burnable gas so produced and then further processed, to give ultimately either SNG for pipeline distribution or synthesis gas and then methanol or ammonia, never loses pressure from that of the discharge of solid residue from the dewatering press.

(c) It is at a high temperature, thus the amount of preheat is minimal. Since the solids carry water, also under the high pressure and temperature, releasing the pressure would cause the water to flash evaporate and cool the solids and remaining water to a much lower temperature.

(d) It is more reactive to the second chemical reactions of gasification than the more highly coalified bituminous coal which is a usual feed stock for gasification processes for solids.

The gasifiers which may be used for reacting the solids and a part of the original water have various types of beds: e.g. Fixed (Lurgi); Fluidized (COGAS, Synthane, $CO_2$ Acceptor, U-Gas); Entrained Flow (Texaco, Bi-Gas, Shell-Koppers, Koppers-Totzek).

Each of these types of gasifiers has its own optimum conditions of operations and in particular, its own design of equipment for the gasification, also for handling the ash. The ash will include the calcium sulfate formed if sulfuric acid coming from sulfur in the combustion has been neutralized with lime. Each system also has its own relative advantages for working with the different conditioned combustible materials produced in the earlier stages of this process. Since the input to the gasifier from the dewatering press can be charged to the gasifier at the particular pressure desired for its optimum operation; and since the discharged product gas may be desired at a high pressure either for pipeline SNG distribution or for use as a syngas in a production of a chemical under pressure, the high pressure gasifiers have a large advantage. Also since the water is fed to the gasifier as an intimate part of the residual solids as the fuel feed stock and as one of the reactants, the steam first formed from it may be used advantageously as the entrainer for carrying the solid particles through the entrained flow type of moving bed.

I claim:

1. In the process for making a burnable gas from an original solid combustible organic material with original water in an amount of from ½ to thirty times the dry weight of the solids of said combustible material, at least some of said water being inseparable by any mechanical means, said burnable gas being formed in part by the chemical reaction of the carbon of said original combustible material with oxygen and with a part of said original water, the steps comprising:

(a) reacting said original combustible material in first chemical reactions in a reaction zone with an oxygen containing gas in the presence of a continuous aqueous phase containing at least a part of said original water at a temperature of between 175° C.

and 325° C. and a pressure of between 10 and 100 atmospheres so that:

(i) said solids of said original combustible material are partially oxidized, thereby producing heat, a part of said heat being used in raising the temperature of said original solid combustible material to the said temperature of said reaction zone, and a part of said heat being used to produce steam under said pressure; and so that:

(ii) some of said original water which was inseparable can now be separated by a mechanical means;

(b) mechanically separating a part of said continuous aqueous phase from the solid residue of said combustible material so that 1 pound of said solid residue on a dry basis after said mechanical separation contains no more than from ½ pound to 2 pounds of water, some part of which is a part of said original water;

(c) passing to a gasifier, without substantial loss of water, without substantial cooling and without substantial loss of pressure, said separated solid residue and some part of said original water which remains therewith; and (d) converting, at a pressure no less than that of said reaction zone, in said gasifier to a burnable gas by second chemical reactions with a second oxygen containing gas at least a part of the carbon of said separated solid residue.

2. In a process according to claim 1 wherein a part of said original water is chemically associated with said original combustible material as to be practically inseparable therefrom by mechanical means; and at least some part of said chemically associated water is released from said chemical association with said combustible material by said first chemical reactions.

3. In a process according to claim 1 wherein said separated water is discharged from said mechanical separation at a pressure higher than that of said reaction zone.

4. In a process according to claim 1 wherein said original combustible material is in said reaction zone for between 2 and 200 minutes.

5. In a process according to claim 1 wherein said original combustible material with said original water is heated within said reaction zone to the temperature of said reaction zone by heat supplied at least in part by that developed by said first chemical reactions of said oxygen containing gas and said original combustible material which have been reacted previously in said reaction zone.

6. In a process according to claim 1 wherein some part of said mechanically separated water is passed back to said reaction zone.

7. In a process according to claim 1 wherein said reaction zone is at a temperature between 240° C. and 300° C. and a pressure of between 70 atmospheres and 100 atmospheres.

8. In a process according to claim 1 wherein said steam and gaseous products of said first chemical reactions in said reaction zone are:

(a) withdrawn at the pressure of said reaction zone; from said reaction zone mixed the solid and liquid products of said first chemical reactions and any solids and liquids which have been unreacted of said original combustible matter and said original water.

(b) separated from said solid and said liquid materials leaving said reaction zone; and (c) expanded through an expansion engine down to some lower exhaust pressure so as to develop power.

9. In a process according to claim 1 wherein said mechanical separation comprises two steps, a sedimentation with a decantation of that part of said water which has been separated during said sedimentation, and a pressing from said solid residue of a part of said water remaining after said sedimentation.

10. In a process according to claim 1 wherein said solid residue is discharged from said mechanical separation of said water at a pressure substantially higher than that of said reaction zone and is passed to said second chemical reactions which convert at least a part of said residue to a burnable gas with a part of said remaining original water.

11. In a process according to claim 1 wherein said mechanically separated water contains water soluble products formed in said first chemical reaction, and said mechanically separated water is passed to a treatment means wherein said water soluble products are separated from said mechanically separated water.

12. In a process according to claim 1 wherein said mechanically separated water contains fermentable materials formed in said first chemical reactions and is passed to a fermenter wherein said fermentable materials are fermented to give useful products, said useful products being separated from said mechanically separated water.

13. In a process according to claim 1 wherein said mechanically separated water is heat interchanged so as to be cooled as it preheats said original combustible matter with said original water being fed to said reaction zone.

14. In a process according to claim 1 wherein said mechanically separated water is cooled by a series of at least two flash evaporations obtained by passing said water into a series of at least two evaporation zones at successively lower pressures, said flash evaporations each producing respective amounts of steam at successively lower pressures, said amount of steam produced at the first and lowest pressure being passed to a first condensation zone also at said first and lowest pressure, wherein it gives up its latent heat by condensing to warm the incoming feed of said original combustible with said original water; said amount of steam from said flash evaporation at the second and next higher pressure is passed to a second condensing zone maintained also at said second and next higher pressure than said first condensing zone, wherein it heats said incoming feed of said combustible material and said water to a higher temperature; and said amount of steam from each respective higher flash evaporation at a successively higher pressure being passed to a respective condensing zone at a successively higher pressure wherein, on condensation, said respective amounts of steam countercurrently heat in succession said incoming feed of said combustible material and said water; said incoming feed, now preheated, leaving the flash evaporator of the highest pressure to be passed to said reaction zone.

15. In a process according to claim 1 wherein said original combustible material is a solid fossil fuel substantially as it is taken from its natural, geologic bed and with at least a part of the original water with which it comes from said bed.

16. In a process according to claim 1 wherein said original combustible material is a solid fossil fuel from which a part of the original water with which it comes from its natural geologic bed has been removed by drying.

17. In a process according to claim 1 wherein said original combustible material is a slurry in water of solid fossil fuel particles.

18. In a process according to claim 1 wherein said original combustible material is a slurry in water of fossil fuel fines at least many of which are less than 100 microns in average diameter.

19. In a process according to claim 1 wherein said first chemical reactions include the hydrolysis of some part of the molecules in said original combustible material.

20. In a process according to claim 1 wherein said burnable gas is produced by said second chemical reactions and is converted without substantial loss of pressure during subsequent steps including methanation to pipeline quality gas of at least 900 BTU per cubic foot.

21. In a process according to claim 1 wherein said burnable gas is produced by said second chemical reactions and is converted without substantial loss of pressure during subsequent steps so as to contain substantial quantities of hydrogen for use as a synthesis gas for production of chemicals when combined with at least one other gas formed in said gasifier.

22. In a process according to claim 1 wherein said burnable gas contains carbon monoxide and hydrogen formed in said second chemical reactions from the said solid separated residue and said water at least a part of which also is from said original combustible material; and said carbon monoxide and said hydrogen are passed without substantial loss of pressure to be chemically combined during subsequent steps to form methanol.

23. In a process according to claim 1 wherein said burnable gas contains hydrogen formed in said second chemical reactions from the said solid separated residue and said water at least a part of which also is from said original combustible material, also nitrogen as a residual of the air used in said second chemical reactions; and said hydrogen and said nitrogen are passed without substantial loss of pressure to be combined chemically during subsequent steps to form ammonia.

24. In a process according to claim 1 wherein said original combustible material contains sulfur, said sulfur being oxidized in the presence of said continuous aqueous phase to give sulfuric acid in said first chemical reactions.

25. In a process according to claim 1 wherein said original combustible material contains sulfur, and an alkaline material is added to the aqueous charge to the reaction zone, said sulfur being oxidized in the presence of said continuous aqueous phase and said alkaline material to give a sulfate salt.

26. In a process according to claim 1 wherein said original combustible material contains sulfur; and an alkaline material is added to said reaction zone, wherein:

(a) said sulfur, said original water, said oxygen containing gas, and said alkaline material react in said first chemical reactions to give a water soluble sulfate salt, and (b) said water soluble sulfate salt is substantially separated, while dissolved in said mechanically separated water, from said solid residue.

27. In a process according to claim 1 wherein said original combustible material contains sulfur; and an alkaline material is added to said reaction zone, wherein:

(a) said sulfur, said original water, said oxygen containing gas, and said alkaline material react in said first chemical reactions to give a substantially water-insoluble sulfate salt;

(b) said substantially water-insoluble sulfate salt is substantially separated together with said solid residue from said mechanically separated water; and (c) said sulfur in said substantially water-insoluble sulfate salt together with said solid residue is not converted to a gaseous compound during said second chemical reactions.

28. In a process according to claim 1 wherein additional water is added to said original combustible material before said first chemical reactions.

29. In a process according to claim 1 wherein said original combustible material is a form of biomass.

30. In a process according to claim 1 wherein said burnable gas is substantially free of sulfur in any form.

31. In a process according to claim 1 wherein said original organic substance is a sludge which contains organic matter obtained from the treatment of sewage.

32. In a process according to claim 1 wherein said original organic substance is fed to said reacting zone continuously.

33. In a process according to claim 1 wherein said original organic substance is charged in batches which are reacted discontinuously in said first chemical reactions.

34. In a process according to claim 1 wherein said solid residue is thermally conditioned by said first chemical reactions so as to have a higher heating value per pound on a dry basis than that of said original combustible material.

35. In a process according to claim 1 wherein said oxygen containing gas used in said first chemical reactions contains at least approximately 90 percent oxygen.

36. In a process according to claim 1 wherein said oxygen containing gas used in said first chemical reactions is air.

* * * * *